United States Patent [19]

Drori

[11] 3,936,244

[45] Feb. 3, 1976

[54] FUEL INJECTION PUMPING APPARATUS

[75] Inventor: Moshe Drori, East Twickenham, England

[73] Assignee: C.A.V. Limited, Birmingham, England

[22] Filed: Feb. 4, 1975

[21] Appl. No.: 546,942

Related U.S. Application Data

[63] Continuation of Ser. No. 396,533, Sept. 12, 1973, abandoned.

[52] U.S. Cl. ..... 417/435; 417/462

[51] Int. Cl.[2] ..... F04B 19/02; F04B 29/00; F04B 39/00

[58] Field of Search ..... 417/435, 462; 137/565.1, 137/565.2

[56] References Cited

UNITED STATES PATENTS

| | | | |
|---|---|---|---|
| 1,981,507 | 11/1934 | Harris et al. | 417/502 |
| 2,118,234 | 5/1938 | Rupp | 417/502 |
| 2,364,550 | 12/1944 | Pelouch | 417/435 |
| 2,847,942 | 8/1958 | Shaw | 417/435 |
| 2,853,947 | 9/1958 | Evans | 417/462 |
| 3,489,093 | 1/1970 | Thormber | 417/502 |

FOREIGN PATENTS OR APPLICATIONS

| | | | |
|---|---|---|---|
| 493,577 | 10/1938 | United Kingdom | 417/462 |
| 357,920 | 12/1956 | Switzerland | 417/462 |

*Primary Examiner*—William L. Freeh
*Attorney, Agent, or Firm*—Holman & Stern

[57] ABSTRACT

A fuel pumping apparatus for supplying fuel to an internal combustion engine includes an injection pump which delivers fuel through a delivery passage which includes a spring loaded delivery valve. A vent conduit extends from the delivery passage, and communicates with a vent conduit during a delivery stroke of the injection pump. The vent conduit communicates with the delivery passage intermediate the injection pump and the delivery valve, and the vent passage includes a screwed plug at its end and a valve element which is resiliently loaded into contact with a seating. The seating is positioned adjacent the vent conduit so that the amount of fuel in the conduit during normal operation of the apparatus, is as small as possible.

4 Claims, 2 Drawing Figures

FUEL INJECTION PUMPING APPARATUS

This is a continuation of application Ser. No. 396,553 filed Sept. 12, 1973, now abandoned.

FIELD OF THE INVENTION

This invention relates to liquid fuel injection pumping apparatus of the kind described in the Specification of U.S. Application Ser. No. 286,337.

SUMMARY OF THE INVENTION

In the specification of my application numbered as above, there is described a liquid fuel injection pumping apparatus for supplying fuel to an internal combustion engine, the apparatus comprising a body part, a rotary distributor mounted in the body part, an outlet passage in the body part adapted for connection to an injection nozzle of an associated engine and a fuel delivery passage in the distributor member, said delivery passage communicating with the pumping chamber of an injection pump and being arranged to register with said outlet passage during delivery of fuel by said injection pump, the apparatus also incorporating a delivery valve disposed in one of said passages, said delivery valve including a spring-loaded valve element which is opened by the flow of fuel from the injection pump, and a valve controlled vent passage in the body part and a vent conduit in the distributor, said vent conduit communicating with the aforesaid fuel delivery passage and being arranged to communicate with said vent passage during the time when fuel is delivered by the injection pump, the arrangement being such that the valve in the vent passage can be opened to allow air to escape through said vent conduit.

In the apparatus described in the specification, the valve controlled vent passage in the body part, comprises a suitably positioned vent passage which extends from the exterior of the body part and which opens onto the periphery of the distributor. The conduit is provided with a screw-threaded portion at its end adjacent the exterior of the body part, the screw-threaded portion receiving a complementarily screw-threaded plug constituting a valve. Moreover, the plug is provided with an elongated extension which substantially fills the passage so that the volume of fuel within the passage is reduced as much as possible.

It has been found to be expensive to machine the passage and also the plug with its extension to the required degree of accuracy so as to ensure that the volume of fuel in the passage remains as small as possible and the object of the present invention is to provide a fuel pumping apparatus of the kind specified in an improved form.

PRIMARY OBJECTS OF THE INVENTION

According to the invention in an apparatus of the kind specified the valve controlled vent passage comprises a passage having at its end adjacent the exterior of the body part a screw-threaded portion to receive a complementarily screw-threaded plug which can be loosened or removed from the passage to permit bleeding of air, the passage also defining at its end adjacent the distributor, a seating, a valve element for co-operation with said seating and resilient means biasing the valve element into contact with the seating.

BRIEF DESCRIPTION OF THE DRAWING

One example of a liquid fuel injection pumping apparatus in accordance with the invention will now be described with reference to the accompanying drawings in which.

DESCRIPTION OF A PREFERRED EMBODIMENT

Figure 1:
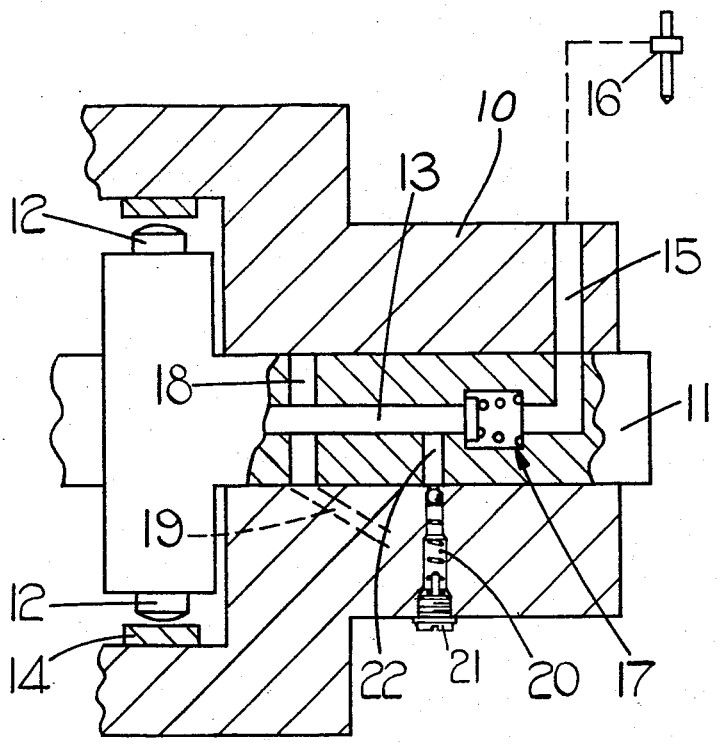
FIG. 1 is a sectional side elevation through the pump.
Figure 2:
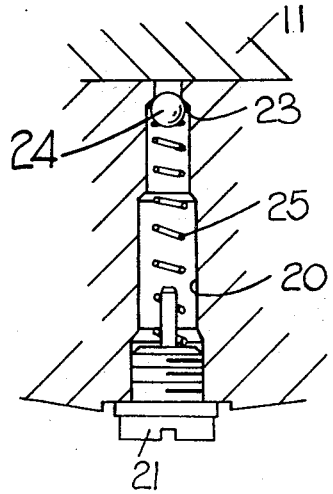
FIG. 2 is a section to an enlarged scale of part of the apparatus of FIG. 1.

Referring to FIG. 1 of the drawings there is provided a body part 10 in which is mounted a rotary cylindrical distributor member 11. The distributor member is adapted to be driven in timed relationship with an engine with which it is associated and at one end of the distributor member there is provided the rotary part of a fuel injection pump including plungers 12. The plungers are located in a bore formed in part of the distributor member and which communicates with a fuel delivery passage 13 formed in the distributor member. The plungers are arranged to be moved inwardly as the distributor member rotates, by the action of cam lobes formed on an annular cam ring 14 which surrounds the distributor member and which is mounted in the body part.

The delivery passage 13 includes a portion which extends to the periphery of the distributor member and this is arranged to register in turn as the distributor member rotates, with a plurality of outlet passages 15 formed in the body part. The outlet passages 15 are connected respectively to the injection nozzles 16 of an associated engine, only one of which is shown. Moreover, located within the delivery passage is a delivery valve which is schematically shown at 17. The valve includes a spring-loaded valve element which is opened by the flow of fuel which occurs along the delivery passage as the plungers 12 are moving inwardly.

Also communicating with the delivery passage 13 are a plurality of inlet passages 18 which in known manner, are arranged to communicate in turn with an inlet port 19 formed in the body part and communicating with a source of fuel at a low pressure. The arrangement is such that when an inlet passage is brought into register with the inlet port 19, fuel can flow from the low pressure source to the injection pump to effect outward movement of the plungers 12. When the plungers are moved inwardly, the passage 18 is out of register with the port 19 so that the fuel displaced by the injection pump flows past the delivery valve to an injection nozzle.

When the apparatus is first manufactured or when in use the fuel supply fails, all the passages will contain air and the strength of the spring which loads the valve element of the delivery valve 17 is such that owing to the presence of the air, the injection pump is unable to build up sufficient pressure to effect opening of the delivery valve and no fuel will be delivered by the apparatus.

In order to overcome this problem there is formed in the body part of the apparatus a vent passage 20 which at one end opens out onto the periphery of the distributor member 11. At its other end the vent passage is closed by a screw plug 21 which constitutes the equivalent of a valve. Moreover, formed in the distributor member is a vent conduit 22 which at one end communicates with the delivery passage 13 and which at its other end breaks out onto the periphery of the distributor member at a position so that it can register with the vent passage 20. The registration of the vent conduit and the vent passage is arranged to occur during a delivery stroke of the injection pump. The arrangement is such that by removing the plug 21 thereby effectively opening the vent passage 20, air will be forced along the passage by the pumping action of the injection pump. At the end of injection stroke a fresh quantity of fuel will be admitted to the injection pump and at the next revolution of the distributor member the process will be repeated until all the air is driven from the passage 13 and fuel commences to flow from the vent passage 20. When this occurs the plug 21 can be replaced and the injection pump by virtue of the fact that substantially all the air has been driven out of the passage 13, will be able to generate sufficient pressure to effect opening of the delivery valve. When this occurs, any remaining air in the passage 13 upstream of the delivery valve will be forced past the delivery valve and through one of the outlets 15.

It is desirable that the volume of fuel in the passage 20 and which is subjected to the pressure generated by the injection pump during the injection stroke, should be kept as small as possible. In the apparatus described in the specification of the main application the plug 21 was provided with an extension which substantially filled the passage 20. In practice this is difficult to manufacture so as to maintain the volume as small as possible and the equivalent object is achieved in the present apparatus by providing a spring-loaded valve element which co-operates with a seating 23 defined in the passage 20. The seating 23 is positioned adjacent the distributor member 11 and the valve element is in the form of a ball 24 which is loaded into contact with the seating 23 by means of a coiled compression spring 25. The plug 21 serves as an abutment for the other end of the coiled compression spring. In operation, during the venting of air the plug 21 is loosened or partially removed as described and the pressurized air lifts the ball 24 off the seating 23 so that it escapes into the passage 20. This process is repeated until the passage 20 is filled with fuel and the latter escapes to the exterior of the apparatus. The plug 21 is then replaced and tightened and the process of venting air continues as described. It will be clear that during the initial injection periods the volume of fuel within the passage 20 will be pressurised to the maximum injection pressure which occurs and during this process fuel will flow past the valve element 24. When the passage 20 has been pressurised to the maximum injection pressure the spring 25 will urge the ball onto the seat 23 so as effectively to close off substantially the whole of the volume of the passage 20 and effectively the volume of fuel which is subjected to injection pressure at each injection stroke is the small volume of fuel contained within the passage 20 intermediate the seating 23 and the periphery of the distributor member.

I claim:

1. A liquid fuel injection pumping apparatus for supplying fuel to an internal combustion engine and comprising a body part, a rotary distributor mounted in the body part, an outlet passage in the body part adapted for connection to an injection nozzle of an associated engine and a fuel delivery passage in the distributor member, said delivery passage communicating with the pumping chamber of an injection pump and being arranged to register with said outlet passage during delivery of fuel by said injection pump, the apparatus also incorporating a delivery valve disposed in one of said passages, said delivery valve including a spring-loaded valve element which is opened by the flow of fuel from the injection pump, a valve controlled vent passage in the body part and a vent conduit in the distributor, said vent conduit communicating with said delivery passage at a point intermediate the pumping chamber and said delivery valve, and with the vent passage during a delivery stroke of the injection pump, the valve controlled vent passage comprising a passage having at its end adjacent the exterior of the body part a screw-threaded portion to receive a complementarily screw-threaded plug which can be loosened or removed from the passage to permit bleeding of air, the passage also defining at its end adjacent the distributor, a seating, a valve element for co-operation with said sealing and resilient means biasing the valve element into contact with the seating.

2. An apparatus as claimed in claim 1 in which said resilient means comprises a coiled compression spring which is interposed between the valve element and the plug.

3. An apparatus as claimed in claim 2 in which said valve element comprises a ball.

4. A liquid fuel injection pumping apparatus comprising a rigid body part, a rotating distributor member mounted in and rotatable with respect to the body part, an outlet passage formed in the body part adapted for connection to a high pressure injection nozzle of an associated engine, a fuel delivery passage formed in the distributor member, said fuel delivery passage registering each time the distributor member rotates with said outlet passage, an injection pump including a cam mounted in the body, a bore formed in the distributor member and a cam actuated plunger slidable in said bore, said delivery passage communicating with said bore and the cam being positioned so that fuel at high pressure is pumped from said bore through the delivery passage and outlet passage when the latter are in register, a delivery valve positioned in one of said passages, said delivery valve including a spring loaded valve element which is opened only by the high pressure of fuel generated as the plunger is moved by the cam to permit fuel to flow to the nozzle, the apparatus including means for manually purging the passage in which the delivery valve is positioned, said means comprising a manually operable valve controlled vent passage formed in the body part and communicating with the atmosphere, a vent conduit formed in the rotary distributor member, said vent conduit communicating with the one of said passages upstream of the delivery valve and being prositioned to periodically communicate with said vent passage only during the time of each rotation of said distributor member when fuel is delivered by the injection pump, the arrangement being such that the valve in the controlled vent passage includes means manually opened to allow air to escape through said vent conduit, whereby such air normally preventing operation of said delivery valve is purged upstream of the delivery valve only during the fuel delivery phase of said injection pump and while the delivery valve is closed, and a valve seat in said vent passage substantially adjacent to the outer periphery of said distributor member, a valve element normally engaged on said valve seat, and resilient means engaging said valve element and urging it into engagement of said valve seat whereby normal operation of said injection pumping apparatus pressurizes said vent passage downstream of said valve element in the vent passage for obtaining precise control of fuel during an injection stroke of the injection pumping apparatus.

* * * * *